US009972470B2

(12) United States Patent
Adake et al.

(10) Patent No.: US 9,972,470 B2
(45) Date of Patent: May 15, 2018

(54) THERMALLY RESPONSIVE SWITCH AND METHOD OF MANUFACTURING SAME

(71) Applicant: UBUKATA INDUSTRIES CO., LTD., Nagoya-shi, Aichi (JP)

(72) Inventors: Takashi Adake, Nagoya (JP); Tomohiro Hori, Nagoya (JP)

(73) Assignee: UBUKATA INDUSTRIES CO., LTD, Nagoya-Shi, Aichi (JP)

( * ) Notice: Subject to any disclaimer, the term of this patent is extended or adjusted under 35 U.S.C. 154(b) by 0 days. days.

(21) Appl. No.: 14/780,874

(22) PCT Filed: Mar. 29, 2013

(86) PCT No.: PCT/JP2013/059557
§ 371 (c)(1),
(2) Date: Sep. 28, 2015

(87) PCT Pub. No.: WO2014/155679
PCT Pub. Date: Oct. 2, 2014

(65) Prior Publication Data

US 2016/0071679 A1 Mar. 10, 2016

(51) Int. Cl.
*H01H 85/055* (2006.01)
*H01H 69/02* (2006.01)
(Continued)

(52) U.S. Cl.
CPC ..... *H01H 85/055* (2013.01); *H01H 9/04* (2013.01); *H01H 37/5427* (2013.01);
(Continued)

(58) Field of Classification Search
CPC .... H01H 85/055; H01H 69/02; H01H 85/165; H01H 37/5427; H01H 9/04; H01H 85/00;
(Continued)

(56) References Cited

U.S. PATENT DOCUMENTS 4,167,721 A * 9/1979 Senor ..... H01H 37/5427 337/112
6,154,117 A * 11/2000 Sato ..... H01H 37/5436 337/354
(Continued)

FOREIGN PATENT DOCUMENTS

CN 101990694 A 3/2011
CN 102915875 A 2/2013
(Continued)

OTHER PUBLICATIONS

International Search Report dated May 7, 2013, for International Patent Application No. PCT/JP2013/059557.
(Continued)

*Primary Examiner* — Anatoly Vortman
*Assistant Examiner* — Stephen Sul
(74) *Attorney, Agent, or Firm* — Karceski IP Law, PLLC

(57) ABSTRACT

A thermally responsive switch is provided with a sealed container having a housing and a cover plate secured to the housing; a couple of conductive thermal pins inserted into a couple of through holes provided on the cover plate and secured by an insulative filler; a stationary contact secured to one of the conductive thermal pins inside the container; a heater having one end connected to the other of the conductive terminal pins inside the container and the other end connected to the cover plate; a thermally responsive plate having one end connected to the housing and being configured to invert a direction of curvature thereof at a predetermined temperature; and a movable contact provided on the other end of the thermally responsive plate. The through holes are configured by cylindrical portions, only the cylindrical portions, the filler, and the conductive terminal pins being covered by an insulative resin.

5 Claims, 10 Drawing Sheets

(51) Int. Cl.

| | |
|---|---|
| ***H01H 85/165*** | (2006.01) |
| ***H01H 9/04*** | (2006.01) |
| *H01H 3/00* | (2006.01) |
| *H01H 37/54* | (2006.01) |
| *H01H 71/20* | (2006.01) |
| *H01H 81/02* | (2006.01) |
| *H01H 85/00* | (2006.01) |

(52) U.S. Cl.
CPC ..... *H01H 69/02* (2013.01); *H01H 85/165* (2013.01); *H01H 3/001* (2013.01); *H01H 37/5418* (2013.01); *H01H 71/20* (2013.01); *H01H 81/02* (2013.01); *H01H 85/00* (2013.01); *H01H 2205/002* (2013.01); *H01H 2223/002* (2013.01)

(58) Field of Classification Search
CPC ..... H01H 2205/002; H01H 2223/002; H01H 37/5418; H01H 3/001; H01H 71/20; H01H 81/02; H01H 85/175; H01H 37/00; H01H 37/52; H01H 83/142; H01H 83/223
USPC ..... 337/205, 14, 16, 100, 102, 103, 298; 29/622
See application file for complete search history.

(56) References Cited

U.S. PATENT DOCUMENTS 6,433,975 B1 * 8/2002 Satoh ..... H01H 37/002 361/23
2009/0315666 A1 * 12/2009 Ueda ..... H01H 1/02372 337/298
2010/0315193 A1 12/2010 Hori et al.
2011/0095860 A1 * 4/2011 Higashikata ..... H01H 37/54 337/298
2013/0234814 A1 * 9/2013 LaFountain ..... H01H 9/04 335/205

FOREIGN PATENT DOCUMENTS

| | | | |
|---|---|---|---|
| JP | H02227928 | A | 9/1990 |
| JP | H06295651 | A | 10/1994 |
| JP | H10144189 | A | 5/1998 |
| KR | 20110018912 | A | 2/2011 |
| WO | WO 2009098735 | A1 | 8/2009 |

OTHER PUBLICATIONS

Mexican Office Action dated Feb. 9, 2017, for Mexican Application No. MX/a/2015/013822.
Chinese Office Action dated Nov. 28, 2016, for Chinese Patent Application No. 2013800752721.
Korean Office Action dated Oct. 20, 2016, for Korean Patent Application No. 10-2015-7024458.
Extended European Search Report dated Nov. 2, 2016, for European Patent Application No. 13880031.3.
Chinese Office Action dated Jun. 8, 2017, for Chinese Patent Application No. 2013800752721.
Philippine Office Action dated Nov. 29, 2017, for Philippine Patent Application No. 1/2015/502229.

* cited by examiner

THERMALLY RESPONSIVE SWITCH AND METHOD OF MANUFACTURING SAME

CROSS-REFERENCE TO RELATED APPLICATIONS

This is a National Stage Entry into the United States Patent and Trademark Office from International PCT Patent Application No. PCT/JP2013/059557, having an international filing date of Mar. 29, 2013, the entire content of which is incorporated herein by reference.

FIELD OF THE INVENTION

The present invention relates to a thermally responsive switch installed as a protective device inside a sealed motor compressor and a method of manufacturing the same.

DESCRIPTION OF RELATED ART

This type of thermally responsive switch is provided with a sealed container and a thermally responsive plate disposed inside the sealed container. The sealed container is formed of a metal housing and a cover plate. The thermally responsive plate, being curved, is configured to invert its direction of curvature at a predetermined temperature. A conductive terminal pin is inserted through the cover plate and is secured airtight to the cover plate by an electrically insulative filler such as glass. At the tip of the conductive terminal pin located inside the sealed container, a stationary contact is attached directly or indirectly via a supporting element, etc. One end of the thermally responsive plate is connected and secured to the inner surface of the sealed container by way of a supporting element, etc. A movable contact is secured to the other end of the thermally responsive plate. The movable contact as well as the stationary contact serve as a make and break contact.

The thermally responsive switch is installed in the sealed housing of the sealed motor compressor and functions as a protector known as a thermal protector for compressor motor applications. When the temperature around the thermally responsive switch becomes abnormally high, or when abnormal current flows through the motor to cause the temperature inside the thermally responsive switch to become abnormally high, the thermally responsive plate is inverted to cause the contacts to be opened and thus, be placed in a non-electrically conductive state. When the temperature falls to a predetermined value or less on the other hand, the thermally responsive plate returns to the original state to close the contacts and thus, be placed in an electrically conductive state.

SUMMARY OF THE INVENTION

It is desirable in a thermally responsive switch to promptly adjust the interior temperature to the exterior temperature or allow the interior temperature to be promptly released to the exterior so that the thermally responsive switch is operated at appropriate temperatures. However, as illustrated in FIGS. 9 and 10 for example, most of the outside surface of the cover plate 104 forming the sealed container 102 in a conventional thermally responsive switch is covered by a resin 121 serving as an electrically insulative coating. The resin 121 significantly reduces the heat conductivity of the sealed container 102. Thus, development of technologies for improving heat conductivity of the sealed container, serving as the main body of the thermally responsive switch, is desired. The type of electrically insulative resin used in this case is applied so as to cover the cover plate and the conductive terminal pin in order to secure insulation distance between the cover plate and the conductive terminal pin. The so-called internal protector belonging to the technical field of the present invention requires at least 2 mm of insulation distance (creepage distance). However, it is difficult to obtain 2 mm of insulation distance by the filler alone which is used for securing the conductive terminal pin. Thus, the required insulating distance is obtained by providing the above described type of electrically insulative resin.

It is one object of the present invention to provide a thermally responsive switch in which heat conductivity of the sealed container can be improved while providing an electrically insulative resin for obtaining insulation distance.

A thermally responsive switch of the present invention is characterized primarily by a through hole through which a conductive terminal pin is disposed. The conductive terminal pin is secured in a cylindrical portion of a cover plate, which is formed by an outwardly projecting portion of the cover plate. Only the cylindrical portion, a filler in the through hole, and the conductive terminal pin are covered by an electrically conductive resin.

Thus, instead of covering most of the outer surface of the cover plate by the resin, only a significantly small portion, including the end portion of the cylindrical portion of the cover plate, is covered by the resin. As a result, the heat conductivity of the sealed container, which includes the main body of the thermally responsive switch, can be significantly improved compared to the conventional technology in which most of the outer surface of the cover plate was covered by the resin. Further, the through hole is defined by the cylindrical portion formed by outwardly projecting the cover plate and, thereby, allows the thickness of the filler (glass) to be maintained. As a result, it is possible to maintain the strength of the portion where the conductive terminal pin is mounted while allowing the thickness of most of the cover plate to be reduced. It is, thus, possible to significantly improve the heat conductivity of the sealed container. Further, the cylindrical portion projecting from the cover plate increases the surface area, i.e., the area of heat conduction of the entire cover plate, which also improves the heat conductivity of the sealed container.

In the thermally responsive switch of the present invention, the shape of the resin material forming the resin prior to being melted preferably has an inner diameter greater than the outer diameter of the conductive terminal pin and an outer diameter less than the sum the outer diameter of the cylindrical portion and 2 mm. As a result, it is possible to cause the melted resin material to stay on the end portion of the cylindrical portion by surface tension without spreading any further. Thus, it is possible to reliably cover the conductive terminal pin portion, including the end portion of the cylindrical portion, by the resin and consequently reliably improve the heat conductivity of the sealed container. The outer diameter of the resin material prior to being melted is preferably less than the sum of the outer diameter of the cylindrical portion and 2 mm at the most, and more preferably less than the sum of the outer diameter of the cylindrical portion and 1 mm. Further, the outer diameter of the resin material prior to being melted is preferably greater than the outer diameter of the cylindrical portion subtracted by 2 mm.

Further, in the thermally responsive switch of the present invention, the conductive terminal pin is formed of a core material made of copper exhibiting excellent heat conductivity. Thus, heat is also transmitted through the conductive terminal pin to improve heat conductivity even more effectively.

BRIEF DESCRIPTIONS OF THE DRAWINGS

The present invention will now be described in connection with the appended drawings, in which.

Figure 1:
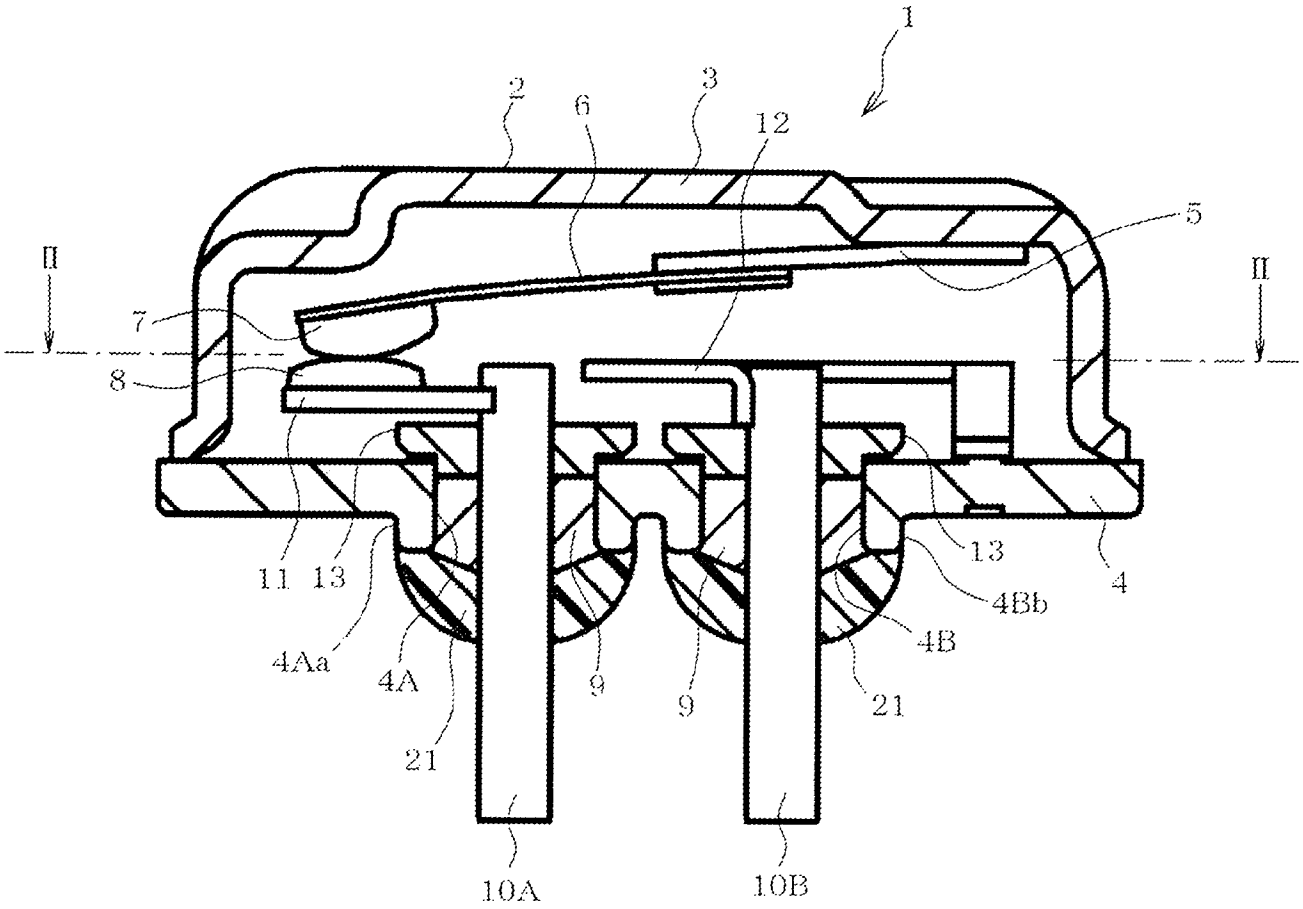
FIG. 1 is a vertical cross sectional view of a thermally responsive switch of one embodiment.
Figure 2:
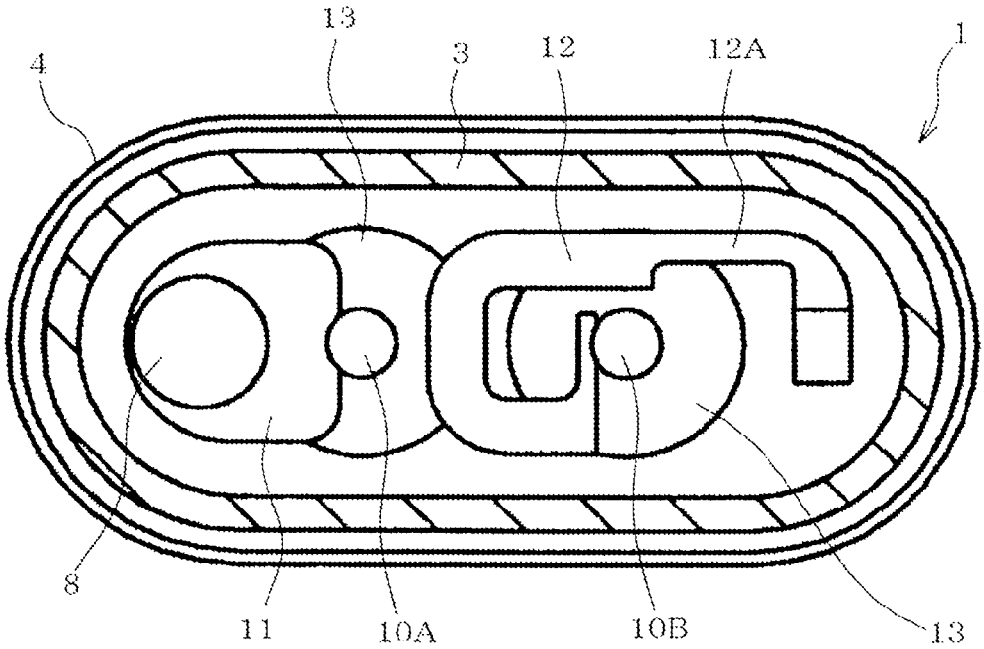
FIG. 2 is a transverse cross sectional view of the thermally responsive switch taken along line II-II of FIG. 1.
Figure 9:
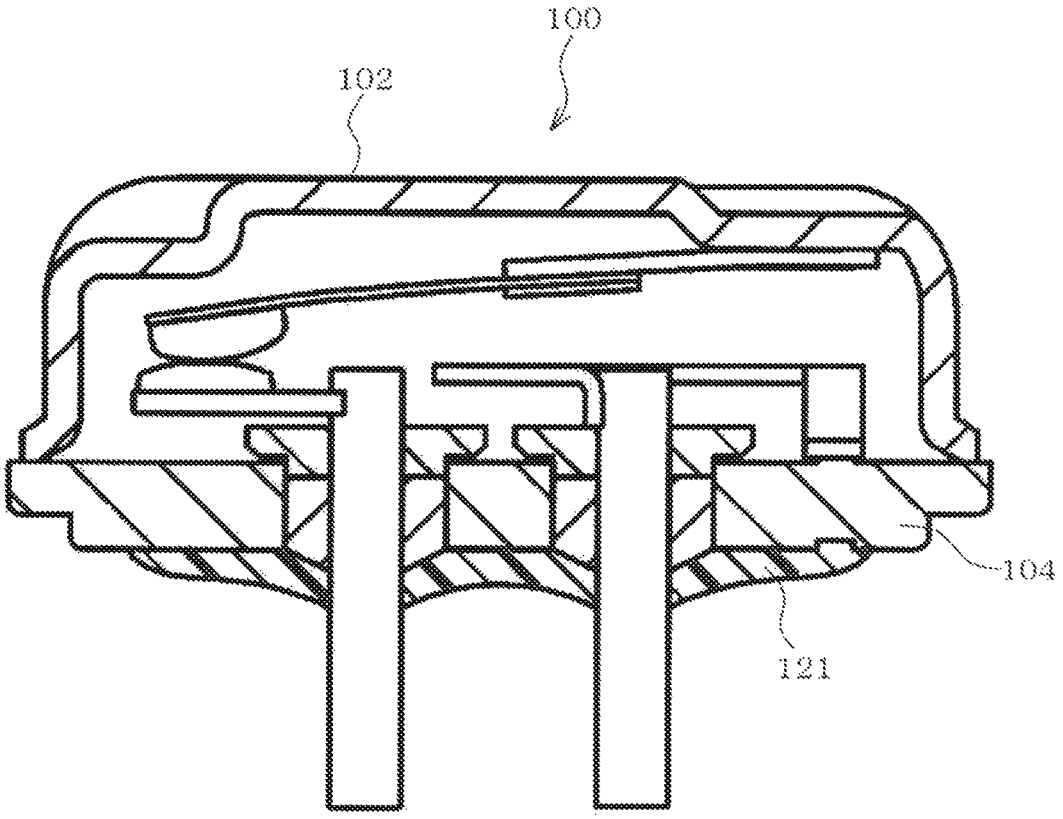
PRIOR ART FIG. 9

FIG. 9 corresponds to FIG. 1 and illustrates a conventional thermally responsive switch.

Figure 3:
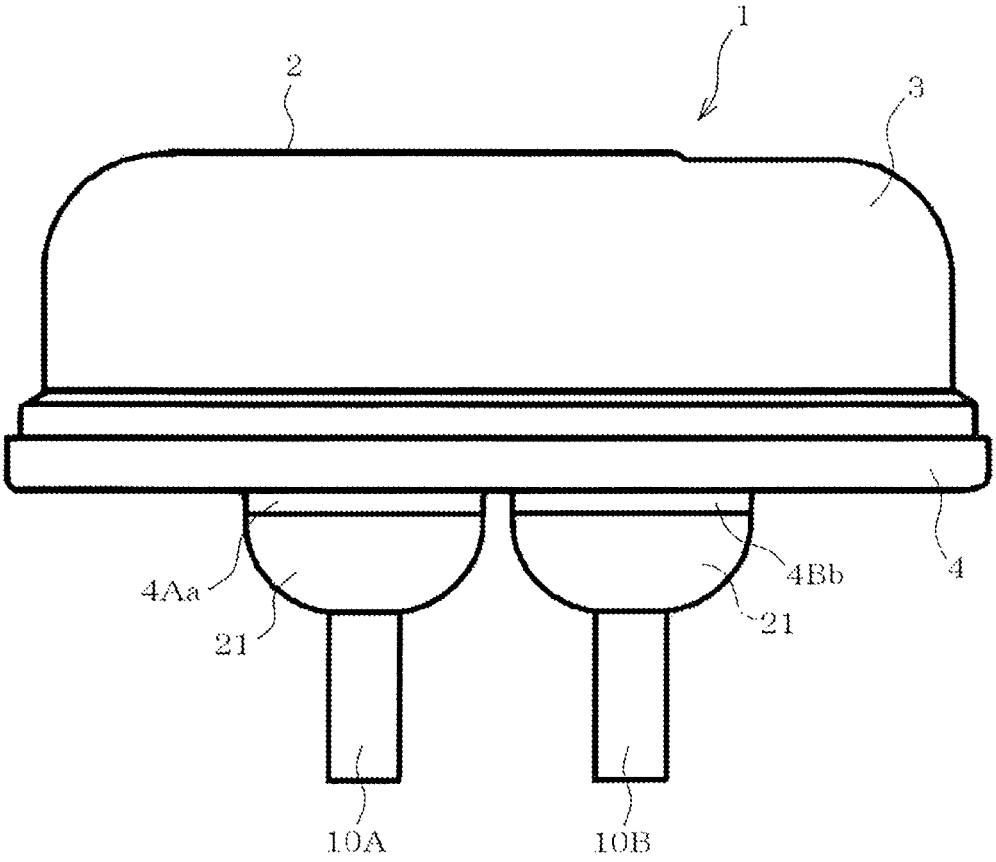
FIG. 3 is a side view of the thermally responsive switch.
Figure 4:
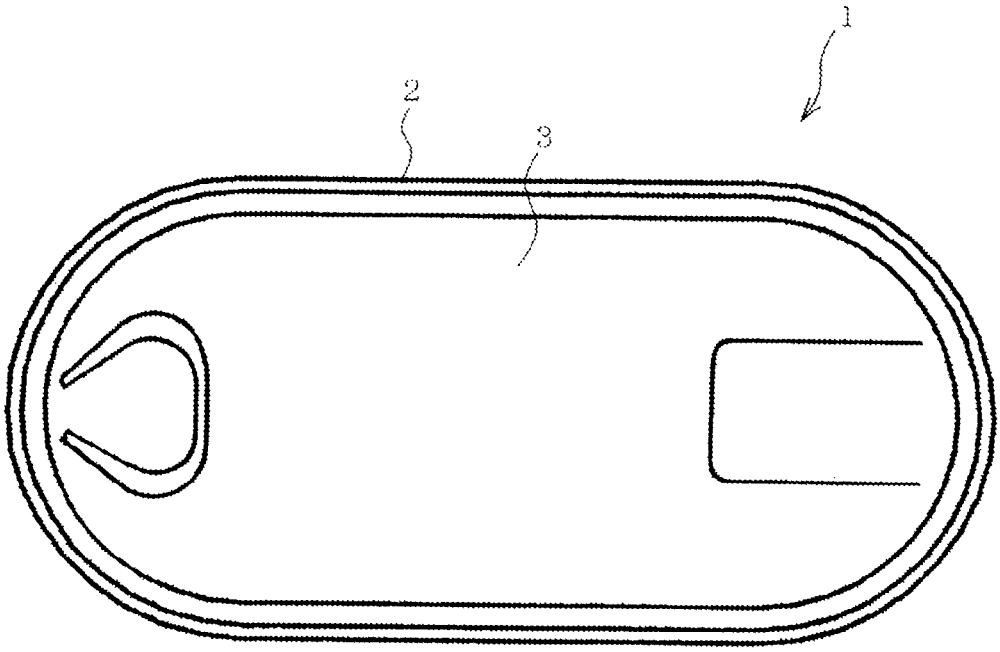
FIG. 4 is a plan view of the thermally responsive switch.
Figure 10:
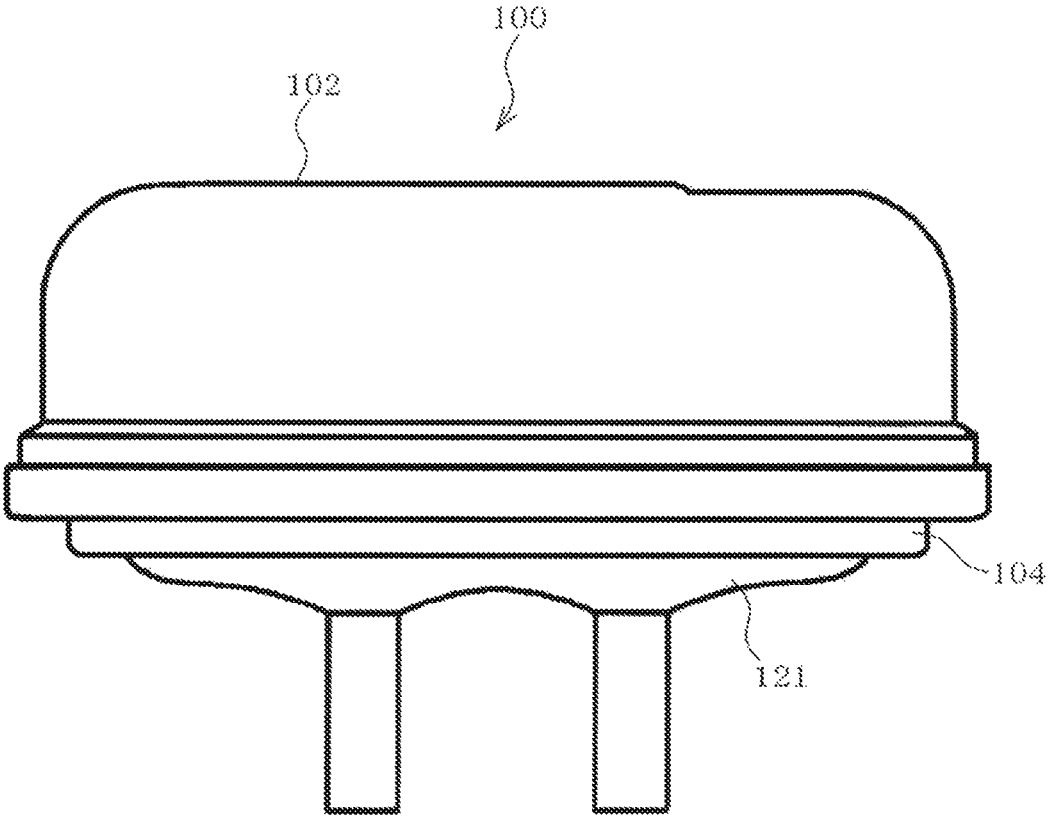
PRIOR ART FIG. 10

FIG. 10 corresponds to FIG. 3 and illustrates a conventional thermally responsive switch.

DETAILED DESCRIPTION OF EMBODIMENTS OF THE INVENTION

One embodiment applying the present invention to a thermal protector (protective device) will be described with reference to the drawings.

As illustrated in FIGS. 1 to 4, a body of a thermally responsive switch 1 is configured by a pressure resistant sealed container 2 which is in turn configured by a metal housing 3 and a cover plate 4. The housing 3 is formed by draw molding an iron plate using a pressing machine. The two ends of the longer sides of the housing 3 are molded into a substantially spherical shape and the mid portion linking the two ends is molded into a shape of an elongated dome having a semicircular cross section. The cover plate 4 formed of an iron plate is molded into a shape of an elongated circle and is sealed airtight against the open end of the housing 3 by ring projection welding, etc.

One end of a thermally responsive plate 6 is connected to the inner side of the sealed container 2 by the intermediary of a support element 5 made of a metal plate. The thermally responsive plate 6 is formed by draw molding a material, which deforms by heat such as a bimetal or a trimetal, into a shape of a shallow dish. The thermally responsive plate 6, being curved, rapidly inverts its direction of curvature when reaching a predetermined temperature. A movable contact 7 is secured to the other end of the thermally responsive plate 6. The portion of the sealed container 2 where the support element 5 is secured is deformed by applying pressure from the outside to control the contact pressure exerted between the movable contact 7 and the stationary contact 8 (later described) and calibrate the temperature where the inverting action of the thermally responsive plate 6 takes place to a predetermined temperature.

The cover plate 4 is provided with through holes 4A and 4B. Conductive terminal pins 10A and 10B are insulated and secured airtight to the through holes 4A and 4B, respectively by a known compression-type hermetic sealing method using a filler 9 formed of electrically insulative material such as glass in consideration of thermal expansion coefficient. The conductive terminal pins 10A and 10B are formed of a clad material (composite metal material) in which copper is used as the core material. A contact support 11 is secured near the tip of the conductive terminal pin 10A located inside the sealed container 2. The stationary contact 8 is secured to the contact support 11 at a location facing the movable contact 7.

One end of a heater 12 serving as a heat generating element is secured near the tip of the conductive terminal pin 10B located inside the sealed container 2. The other end of the heater 12 is secured to the upper surface (inner surface) of the cover plate 4. The heater 12 is disposed along the periphery of the conductive terminal pin 10B so as to be substantially parallel with the thermally responsive plate 6. The heat generated by the heater 12 is transmitted efficiently to the thermally responsive plate 6.

The heater 12 is provided with a fuse portion 12A (see FIG. 2) having a cross sectional area smaller than other portions of the heater 12. While the compressor, being the target of control in this example, is running normally, the fuse portion 12A will not melt by the operational current of a later described electric motor 204 (see FIG. 8). When the electric motor 204 is locked, the fuse portion 12A will not melt in this case as well since the thermally responsive plate 6 is inverted to open the contacts 7 and 8 in a short period of time. When the thermally responsive switch 1 repeats the opening-closing cycles over a long period of time to exceed the guaranteed count of operations, the movable contact 7 and the stationary contact 8 may weld together and become inseparable. When the rotor of the electric motor 204 is locked in this state, excessive current is produced to elevate the temperature of the fuse portion 12A which will eventually cause the fuse portion 12A to melt and ensure that the electric path is cutoff. It is thus, possible to ensure that the electric motor 204 is de-energized.

A thermally resistant inorganic insulating member 13 such as ceramics, zirconia (zirconium dioxide) is tightly secured in a spaceless manner above the filler 9 securing the conductive terminal pins 10A and 10B. The shape of the thermally resistant inorganic insulating member 13 is determined based on pre-designed properties such as electric strength against creeping discharge and physical strength such as thermal resistivity against sputtering. As a result, it is possible to maintain sufficient insulativity even when sputtered materials produced when the heater 12 is fused is attached to the surface of the thermally resistant inorganic insulating member 13. It is thus, possible to prevent arc produced between the fuse portions from transferring to a location between the conductive terminal pin 10B and the cover plate 4 and to a location between conductive terminal pins 10A and 10B.

When current flowing through the electric motor 204 is a normal operational current, which includes a starting current flowing over short period of time, contacts 7 and 8 of the thermally responsive switch 1 stays closed. As a result, electric path formed of the conductive terminal pin 10A-stationary contact support 11-stationary contact 8-movable contact 7-thermally responsive plate 6-thermally responsive plate support 5-housing 3-cover plate 4-heater 12-conductive terminal pin 10B is maintained. Thus, the electric motor 204 stays energized. In contrast, the above described electric path is cutoff as the contacts 7 and 8 are opened by the inversion of the direction in which the thermally responsive plate 6 is curved when: the load of the electric motor 204 is increased and unusually large current flows continuously; the electric motor 204 is locked and significantly large current flows continuously for a few seconds or more; or the temperature of refrigerant inside a pressure resistant airtight container 202 (sealed housing) of the motor compressor 201 later described becomes abnormally high. Thus, the thermally responsive switch 1 is de-energized. Then, when the internal temperature of the thermally responsive switch 1 is reduced, the thermally responsive plate 6 reverses its direction of curvature to close the contacts 7 and 8 and start energization of the electric motor 204.

The through holes 4A and 4B of the thermally responsive switch 1 are configured by the cylindrical portions 4Aa and 4Bb which are obtained, for example, by burring a portion of the cover plate 4 to project in the shape of a cylinder (a circular cylinder in this example). Only the end portions (tip portions) of the cylindrical portions 4Aa and 4Bb, the filler 9, and a portion (a portion near the filler 9) of the conductive terminal pins 10A and 10B are covered by the electric insulative resin 21 serving as a coating material. Thermoset resin such as an epoxy resin is used as the resin 21. The resin 21 is required to cover at least the entirety of the surface of the filler 9, in which case, the resin 21 is preferably formed into a spherical surface (creepage surface) having a diameter of at least 3.6 mm (φ3.6 mm). As a result, it is possible to secure sufficient insulation distance (insulation distance of at least 2 mm or more) between the cover plate 4 and the conductive terminal pins 10A, 10B. Further, the amount of projection and the diametrical dimension of the cylindrical portions 4Aa and 4Bb may be modified as required.

Figure 5:
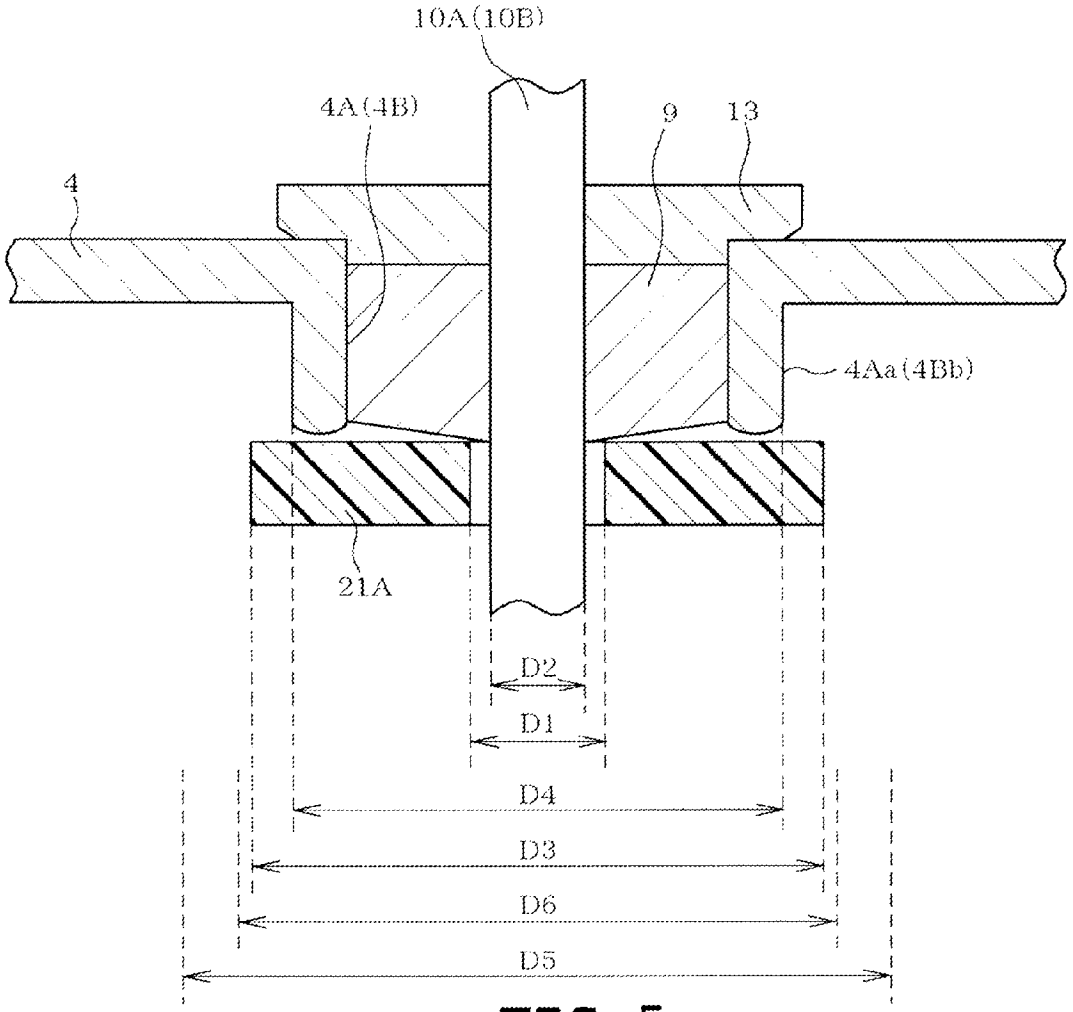
FIG. 5 is an enlarged view of a main portion illustrating the state before a resin material is melted.

Next, a description will be given on a method of manufacturing the thermally responsive switch 1 in which the end portions of the cylindrical portions 4Aa and 4Bb, the filler 9, and portions of the conductive terminal pins 10A and 10B are covered by the resin 21. That is, conductive pins 10A and 10B are inserted into through holes 4A and 4B formed by cylindrical portions 4Aa and 4Bb protruding outward in a cylindrical shape from the cover plate 4 and these conductive pins 10A and 10B are insulated and secured by the filler 9 as illustrated in FIG. 5. Then, the ring shaped resin pellet 21A used as one example of a resin material is disposed on the end portions of the cylindrical portions 4Aa and 4Bb in the above described state. Then, the resin pellet 21A is melted and thereafter solidified to obtain a thermally responsive switch 1 in which the end portions of the cylindrical portions 4Aa and 4Bb, the filler 9, and portions of the conductive terminal pins 10A and 10B are covered by the resin 21.

As illustrated in FIG. 5, the resin pellet 21A is formed into a ring shape having a predetermined thickness (1 mm for example). The inner diameter D1 of the resin pellet 21A is formed so as to be at least larger than the outer diameter D2 of conductive terminal pins 10A and 10B. In this example, the inner diameter D1 of resin pellet is 1.8 mm.

Outer diameter D3 of resin pellet 21A is preferably less than dimension D5 which is the sum of outer diameter D4 of the cylindrical portions 4Aa and 4Bb and 2 mm, and more preferably less than dimension D6 which is the sum of the outer diameter of the cylindrical portions 4Aa and 4Bb and 1 mm. In this example, the outer diameter of the cylindrical portions 4Aa and 4Bb is approximately 5 mm and the outer diameter of the resin pellet 21A is 5.5 mm which is less than dimension D5 (7 mm) being a sum of the cylindrical portions 4Aa and 4Bb (5 mm) and 2 mm and which is further less than dimension D6 (6 mm) being a sum of the cylindrical portions 4Aa and 4Bb (5 mm) and 1 mm.

Outer diameter D3 of resin pellet 21A is preferably greater than the outer diameter of the cylindrical portions 4Aa and 4Bb subtracted by 2 mm, and more preferably greater than the outer diameter of the cylindrical portions 4Aa and 4Bb (the dimension obtained by subtracting 0 mm from the cylindrical portions 4Aa and 4Bb). In this example, the outer diameter of resin pellet 21A is 5.5 mm which is greater than the outer diameter of the cylindrical portions 4Aa and 4Bb (5 mm) subtracted by 2 mm (which amounts to 3 mm) and which is greater than the outer diameter of the cylindrical portions 4Aa and 4Bb (5 mm).

To summarize, the maximum permissible dimension of outer diameter D3 of the resin pellet 21A is the sum of the outer diameter of the cylindrical portions 4Aa and 4Bb and 2 mm, and more preferably sum of the outer diameter of cylindrical portions 4Aa and 4Bb and 1 mm. On the other hand, the minimum permissible dimension of the outer diameter of the resin pellet 21A is the dimension obtained by subtracting 2 mm from the outer diameter of the cylindrical portions 4Aa and 4Bb, and more preferably equals the outer diameter of the cylindrical portions 4Aa and 4Bb. In the present embodiment, the outer diameter of the resin pellet 21A is specified to 5.5 mm within the more preferable range (being greater than the outer diameter of the cylindrical portions 4Aa and 4Bb and less than the sum of the cylindrical portions 4Aa and 4Bb and 1 mm).

Further, the total amount of the resin 21 at each location, in other words, the total amount of resin in each resin pellet is preferably determined based on the size of the openings of through holes 4A and 4B, the diameter of the cylindrical portions 4Aa and 4Bb, the diameter of conductive terminal pins 10A and 10B, and properties of the resin material (such as whether the resin material flows easily or does not flow easily, viscosity, whether the resin material melts easily or does not melt easily). It is preferable to cover the end portions of the cylindrical portions 4Aa and 4Bb with the resin 21 without causing interconnected cells or non-interconnected cells so that the entirety of the filler 9 is not visible from the outside. Thus, the total amount of the resin 21 (i.e., the total amount of resin in the resin pellet 21A) is selected to be a sufficient amount to achieve the above described state. The total amount of resin in the resin pellet 21A is preferably controlled so as not to unnecessarily interfere with the conductive terminal pins 10A and 10B and so as not to unnecessarily extend along the conductive terminal pins 10A and 10B when melted.

Figure 6:
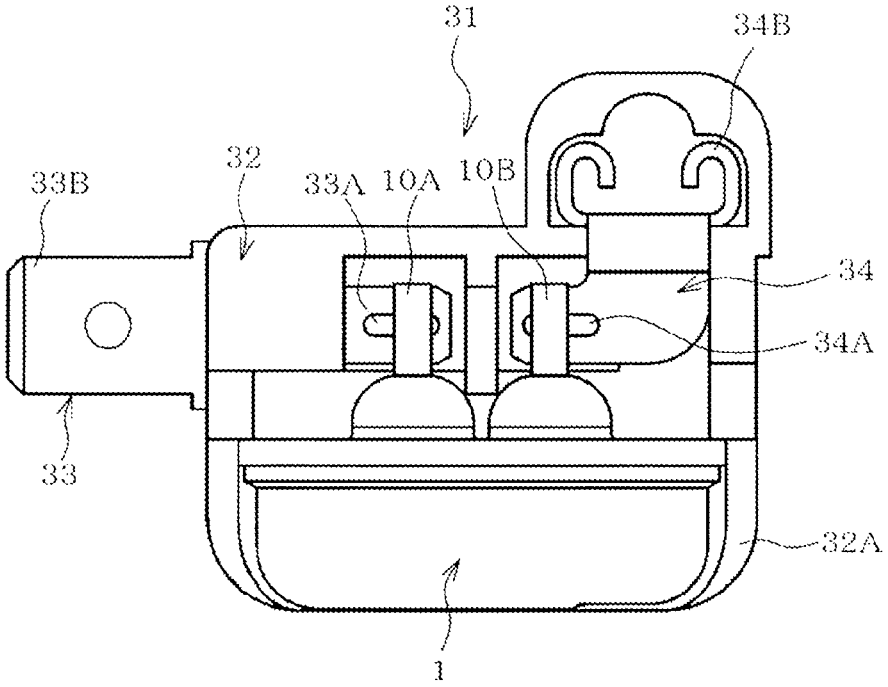
FIG. 6 is an external view of a protection unit.
Figure 7:
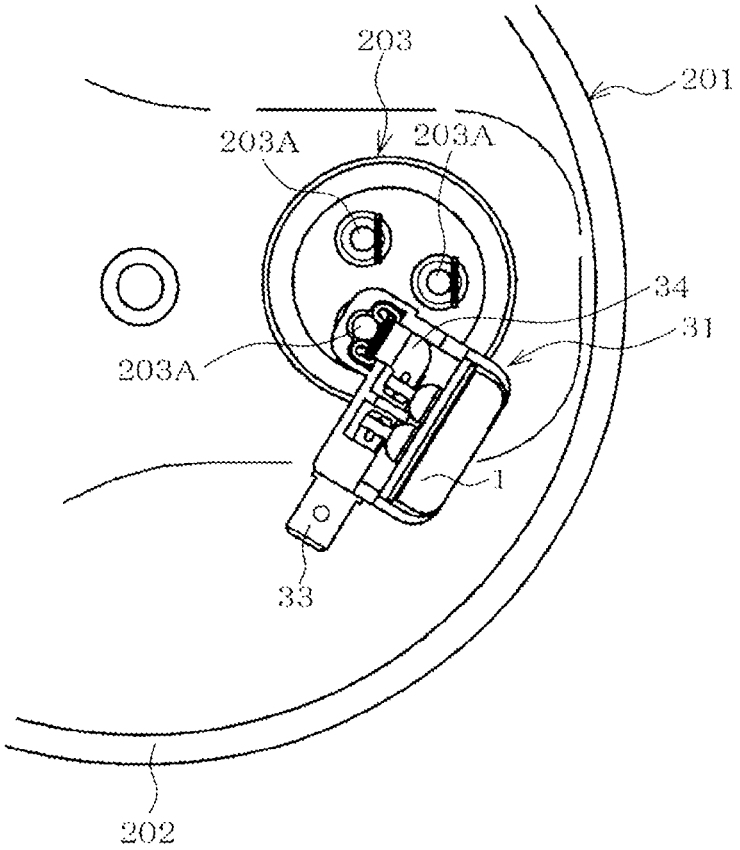
FIG. 7 is a view illustrating one example of installing the thermal responsive switch to the protection unit (part 1).
Figure 8:
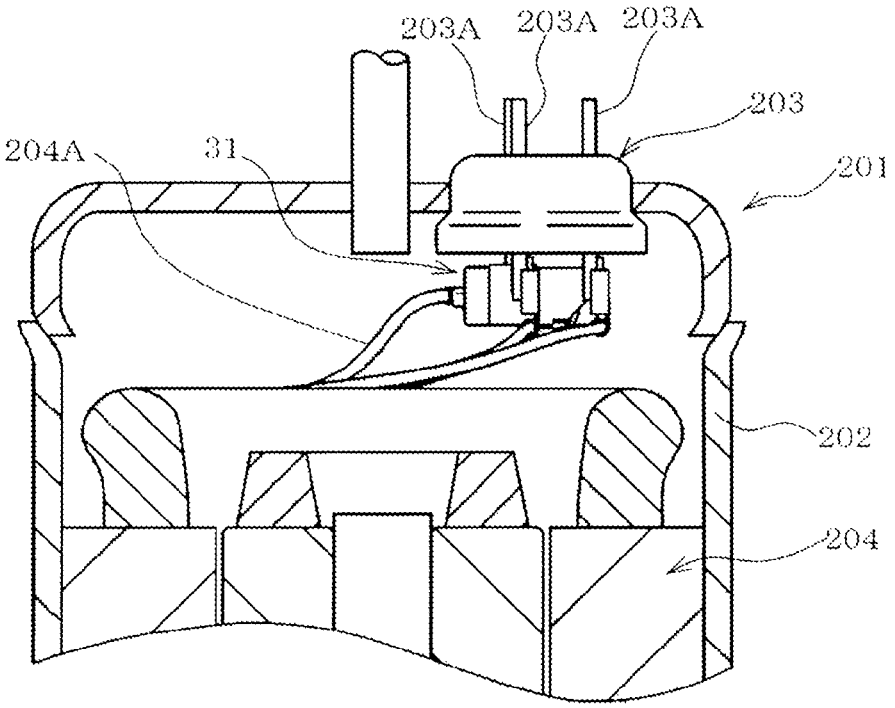
FIG. 8 is a view illustrating one example of installing the thermal responsive switch to the protection unit (part 2).

Next, a description will be given on one example of how the thermally responsive switch 1, structured as described above, is mounted to a sealed motor compressor as illustrated in FIGS. 6 to 8.

As illustrated in FIG. 6, thermally responsive switch 1 is structured as described above to serve as a protection unit 31 held in a case 32 formed of an electrically insulative synthetic resin, etc. One connection terminal member 33 is insert molded into the case 32. The conductive terminal pin 10A configuring the thermal responsive switch 1 is secured by welding at an end portion 33A of the connection terminal member 33 disposed proximal to the case 32. The other end of the connection terminal member 33 located outside the case 32 serves a tab terminal 33B.

Further, another connection terminal member 34, being mounted on the case 32, is secured at a predetermined location of the case 32 by snap action. The conductive terminal pin 10B configuring the thermal responsive switch 1 is secured by welding at an end portion 34A of the connection terminal member 34 disposed proximal to the case 32. The other end of the connection terminal member 34 serves as a receptacle terminal 34B connected to the exterior of the motor compressor 201. The thermally responsive switch 1 is disposed so that the peripheral portion of the housing 3 is covered by the protection wall 32A. However, a clearance is provided between the protection wall 32A and the housing 3. Thus, refrigerant flows in the clearance to exchange heat with the housing 3.

As illustrated in FIGS. 7 and 8, the protection unit 31 is disposed inside the pressure resistant airtight container 202 of the sealed motor compressor 201. An airtight terminal 203 is mounted to the pressure resistant airtight container 202 of the airtight motor compressor 201. The airtight terminal 203 is provided with multiple terminal pins 203A and the receptacle terminal 34B of the protection unit 31 is connected to either of the terminal pins 203A. The terminal pin 203A has a tab terminal secured thereto by welding. The rotation of the protection unit 31 with respect to the terminal pin 203A is prevented by combining the tab terminal and the receptacle terminal 34B. A main winding 204A (see FIG. 8) of the motor 204 is connected to the connection terminal member 33 of the protection unit 31. The protection unit 31 is disposed in series between a power supply and the motor 204. Thus, supply of power to the motor 204 is thus, cutoff by the operation of the thermally responsive switch 1 when the motor compressor 201 encounters abnormalities.

In the above described embodiment of the thermally responsive switch 1, the through holes 4A and 4B to which the conductive terminal pins 10A and 10B are secured are configured by cylindrical portions 4Aa and 4Bb formed by outwardly projecting a portion of the cover plate 4. The cylindrical portions 4Aa and 4Bb, the filler 9, and a portion of the conductive terminal pins 10A and 10B are covered by the electrically insulative resin 21. It is thus, possible to significantly improve the heat conductivity of the sealed container 2 configuring the body of the thermally responsive switch 1.

The present invention is not limited to the embodiment described above but may be modified or expanded within the spirit of the invention. For example, the resin 21 may also cover the side surfaces of the cylindrical portions 4Aa and 4Bb in addition to the end portions of the cylindrical portions 4Aa and 4Bb.

What is claimed is:

1. A thermally responsive switch comprising:

a sealed container formed of a metal housing and a cover plate secured airtight to an open end of the housing;

two conductive terminal pins respectively inserted into two through holes provided on the cover plate and respectively secured airtight by an electrically insulative filler;

a stationary contact secured to one of the two conductive terminal pins inside the sealed container;

a heater having one end connected to the other of the two conductive terminal pins inside the sealed container and the other end connected to the cover plate;

a thermally responsive plate having one end connected to an inner surface of the housing and being configured to invert a direction of curvature thereof at a predetermined temperature;

a movable contact provided on the other end of the thermally responsive plate and being configured for intermittent contact with the stationary contact, wherein when the movable contact and the stationary contact are welded, the heater is configured to melt so that an electric path is cutoff;

two cylindrical portions projecting outwardly from the cover plate to surround the two through holes; and an electrically insulative resin covering only the two cylindrical portions, the filler, and the two conductive terminal pins, wherein the resin is a solidified melt of a ring-shaped resin material covering only the two cylindrical portions, the filler, and the two conductive terminal pins, and wherein the resin material prior to being melted has an inner diameter being greater than an outer diameter of the two conductive terminal pins and an outer diameter being less than a sum of an outer diameter of the two cylindrical portions and 2 mm.

2. The thermally responsive switch according to claim 1, wherein the outer diameter of the resin material prior to being melted is less than a sum of the outer diameter of the two cylindrical portions and 1 mm.

3. The thermally responsive switch according to claim 1, wherein the outer diameter of the resin material prior to being melted is greater than the outer diameter of the two cylindrical portions subtracted by 2 mm.

4. The thermally responsive switch according to claim 1, wherein the two conductive terminal pins are formed of a copper core material.

5. A method of manufacturing a thermally responsive switch provided with a sealed container formed of a metal housing and a cover plate secured airtight to an open end of the housing; two conductive terminal pins respectively inserted into two through holes provided on the cover plate and respectively secured airtight by an electrically insulative filler; a stationary contact secured to one of the two conductive terminal pins inside the sealed container; a heater having one end connected to the other of the two conductive terminal pins inside the sealed container and the other end connected to the cover plate; a thermally responsive plate having one end connected to an inner surface of the housing and being configured to invert a direction of curvature thereof at a predetermined temperature; and a movable contact provided on the other end of the thermally responsive plate and being configured for intermittent contact with the stationary contact, in which, when the movable contact and the stationary contact are welded, the heater melts so that an electric path is cutoff, the method comprising:

forming each of the two through holes by projecting the cover plate outward to form the two cylindrical portions; and covering only the two cylindrical portions, the filler, and the two conductive terminal pins with an electrically insulative resin by solidifying a melt of a ring-shaped resin material at end portions of the two cylindrical portions, wherein the resin material prior to being melted has an inner diameter being greater than an outer diameter of the two conductive terminal pins and an outer diameter being less than a sum of an outer diameter of the two cylindrical portions and 2 mm.

* * * * *